United States Patent [19]

Abrahami

[11] 4,283,451

[45] Aug. 11, 1981

[54] LIGHT-TRANSMITTING ROOFING AND CLADDING PANEL

[75] Inventor: Shoshana Abrahami, Haifa, Israel

[73] Assignee: Ziklag Reinforced Plastics, Ltd., Haifa, Israel

[21] Appl. No.: 23,963

[22] Filed: Mar. 26, 1979

[30] Foreign Application Priority Data

Jun. 9, 1978 [IL] Israel ..... 54879
Jul. 13, 1978 [IL] Israel ..... 55141

[51] Int. Cl.[3] ..... B32B 3/28; B32B 27/20

[52] U.S. Cl. ..... 428/182; 52/309.1; 52/309.13; 156/71; 350/259; 428/207; 428/209; 428/220; 428/913

[58] Field of Search ..... 428/182, 184, 186, 913, 428/220, 207, 209; 52/18, 309.1, 534, 22, 306, 309.13; 350/259, 260, 264; 264/286; 427/164, 161; 126/270

[56] References Cited

U.S. PATENT DOCUMENTS

| | | | |
|---|---|---|---|
| 2,958,259 | 11/1960 | Ewing | 350/259 |
| 3,071,180 | 1/1963 | Finger et al. | 156/210 |
| 3,716,431 | 2/1973 | Townsend | 156/179 |
| 4,035,539 | 7/1977 | Luboshez | 350/259 |
| 4,103,059 | 7/1978 | Kautz | 428/182 |

*Primary Examiner*—Paul J. Thibodeau
*Attorney, Agent, or Firm*—Oblon, Fisher, Spivak, McClelland & Maier

[57] ABSTRACT

The invention provides a light transmitting roofing or cladding panel comprising a translucent rigid plastic sheet formed into a corrugated structural panel wherein parallel slopes of the corrugated panel are provided with a reflecting and opacifying material to form alternate light transmitting and light reflecting zones of a fixed ratio whereby said panels are adapted upon proper positioning relative to the sun's apparent passage to allow natural sunlight to pass therethrough while at the same time minimizing penetration of the sun's heat radiation. The invention also provides a method of providing natural sunlight for buildings, workshops and warehouses while minimizing penetration of the sun's heat rays comprising positioning said panel in a structure with the translucent light transmitting zones thereof substantially facing north.

9 Claims, 3 Drawing Figures

LIGHT-TRANSMITTING ROOFING AND CLADDING PANEL

The present invention relates to light-transmitting roofing or cladding panels. More particularly the present invention relates to rigid plastic panels especially adapted for use in buildings, workshops and warehouses which panels are specially designed to permit natural sunlight to pass therethrough while at the same time minimizing penetration of the sun's heat radiation. The present invention also relates to a process for forming said panels and to a method for providing natural sunlight for buildings, workshops and warehouses while minimizing penetration of the sun's heat rays using said panels.

As is known, one of the major problems in workshops and warehouses is the necessity of using costly electrical lighting, since when sufficient glass windows or plastic paneled windows or roof elements are used to give adequate lighting, these same transparent or translucent windows or roof elements permit the sun's heat to penetrate causing high temperatures in the working interior and making it extremely uncomfortable to work. For this reason, it is generally accepted to install windows facing the North, since the northern light provides light without the heat rays that accompany the direct sunlight from the southern direction, however, it is recognized that northern facing windows alone are inadequate for providing sufficient light for most structures even if said structures do not contain internal partitions which partitions are, in fact, characteristic of most structures.

One of the suggested solutions to this lighting problem is the construction of so-called saw-tooth roofs or shed roofs as described in British Pat. No. 556,218 and U.S. Pat. Nos. 1,347,669 and 2,203,314, which type of construction involves a number of successive roof portions sloping to one side, wherein the side of the roof opposite the sloping portion is substantially upright on a vertical plane, faces the North and has windows for admitting light. Besides being unsightly, these saw-tooth constructions are major costly constructions and are not adapted for inexpensive erection on existing structures. Israel Pat. No. 37343 discloses a roofing element made of plastic which is supposed to be an improvement over the previous saw-tooth roofs known heretofore. The roofing element described in this patent, however, still requires special construction and is costly.

In contradistinction to said prior art constructions and solutions, there is now provided according to the present invention a light transmitting roofing or cladding panel comprising a translucent rigid plastic sheet formed into a corrugated structural panel wherein parallel slopes of the corrugated panel are provided with a reflecting and opacifying material to form alternate light transmitting and light reflecting zones of a fixed ratio whereby said panels are adapted upon proper positioning relative to the sun's apparent passage, to allow natural sunlight to pass therethrough while at the same time minimizing penetration of the sun's heat radiation.

As will be realized, a panel thus constructed and placed on a roof or on a wall as a covering material with the opaque slopes facing the South will prevent the heat rays of the sun from entering the building. However, the opposite translucent slopes which face the North will permit natural light free of the suns heat rays to be transmitted. Another advantage of this invention is to minimize the need for electric light in buildings, workshops and warehouses by using the said corrugated panels as roofing or cladding elements thus permitting natural light to enter the building in sufficient amounts to minimize or eliminate the need for the use of electricity. A further advantage of this invention is its effect of maintaining cooler temperatures inside buildings, workshops and warehouses having roofing or cladding materials of said corrugated sheets which minimize the penetration of the sun's heat rays into the interior of the building.

As stated, the panels of the present invention are of rigid plastic wherein the ratio of light transmitting to light reflecting area of each panel is fixed and immutable as opposed to the resilient plastic corrugated films known in the prior art which are provided with opaque reflecting strips but which are adapted only to serve as venetian blinds for windows and in which the ratio of light reflecting area to light transmitting area is constantly changeable by folding and/or rotating portions thereof.

Thus in the structural rigid panels of the present invention which are especially adapted to serve as roofing or cladding panels preferably the area of the reflecting zones is equal to our greater than that of the light transmitting zones to assure the minimization of the penetration of the sun's heat radiation while still allowing sufficient light penetration.

One of the major advantages of the panels of the present invention is that in their preferred embodiments they are shaped for overlapping juxtapositioning with standard asbestos and sheet metal corrugated panels, e.g. said corrugated panels can preferably be formed with curved crests for overlapping juxtapositioning with standard curved asbestos corrugated panels, predominately used in Israel today, although other shapes are also possible and envisioned for use in countries having corrugated asbestos or sheet metal roofing or cladding panels of other configurations.

Thus another preferred aspect of the present invention relates to a method of providing natural sunlight for buildings, workshops and warehouses while minimizing penetration of the sun's heat rays comprising providing a light transmitting roofing or cladding panel made of a translucent rigid plastic sheet formed into a corrugated structural panel wherein parallel slopes of the panel are provided with a reflecting and opacifying material to form alternate light transmitting and light reflecting zones of a fixed ratio and positioning said panels in a structure with the translucent light transmitting zones thereof substantially facing north, preferably with said panels positioned in openings between standard asbestos or sheet metal corrugated panels with their edges in juxtapositional overlap therewith.

In U.S. Pat. No. 3,163,689 there is described a general method for preparing fiberglass reinforced polyester sheets and in U.S. Pat. Nos. 3,716,431 and 3,905,858 and in corresponding British Pat. No. 1,238,363 there are described processes and apparatus for continuously preparing striped sheet material which processes and apparatus could be used to prepare the light transmitting panels of the present invention. Similarly in U.S. Pat. Nos. 3,079,644 and 3,230,284 as well as in the article by Charles Bell, How to Build Fibreglass Boats, Coward-McCann, New York, 1957 p. 49–51 there are described plastic articles having multi-colored surfaces as well as those having colored stripes. None of said publications, however, teaches or suggests the novel idea of the present invention of providing a light transmitting roofing or cladding panel comprising a translucent rigid plastic sheet formed into a corrugated structural panel wherein parallel slopes of the corrugated panel are specifically selected to be provided with a reflecting and opacifying material to form alternate light transmitting and light reflecting zones of a fixed ratio whereby said panels are adapted upon proper positioning relative to the sun's apparent passage to allow natural sunlight to pass therethrough while at the same time minimizing penetration of the sun's heat radiation.

As will be described with reference to the examples hereinafter said panels will preferably be formed from fiberglass reinforced polyester although corrugated sheeting of other rigid plastic materials may also be prepared as is known in the art. Thus for example rigid P.V.C. can be calendered and reflecting and opacifying pigments, such as $TiO_2$ and magnesium oxide and aluminum oxide, etc. introduced along parallel strips during the calendering operation and subsequently the calendered sheets can be pressed in a corrugating mold.

Alternatively films containing opacifying and reflecting material can be laminated onto rigid plastic translucent thermoplastic sheeting and subsequently corrugated in a mold.

Fibreglass reinforced polyester panels are, however, preferred for several reasons including the fact that said material diffuses light penetrating therethrough and minimizes the amount of light reflected back through the panel while also serving as a structural panel suitable and accepted in the building industry as a roofing element.

Preferred are panels wherein said reflecting and opacifying material is embedded within the surface of said panel, as described, e.g. in the examples hereinafter to form a panel whose edge is consequently of uniform cross-section having a cross-sectional thickness of about 0.3 to about 3 mm, and more preferably a cross-sectional thickness of about 0.5 to about 1.5 mm and especially preferred are panels wherein said reflecting and opacifying material is concentrated in a thin layer near the upper surface of said panel, to maximize heat reflection while minimizing the amount of reflecting and opacifying material used.

While the invention will now be described in connection with certain preferred embodiments in the following examples and with reference to the attached figures in order that it may be more fully and readily understood, it should be clear that it is not intended to limit the invention to these particular embodiments. On the contrary it is intended to cover all alternatives, modifications and equivalents as may be included within the scope of the invention as defined by the appended claims. Thus, the following examples which include preferred embodiments will serve to illustrate the practice of this invention, it being understood that the particulars described are by way of example and for purposes of illustrative discussion of preferred embodiments of the present invention only and are presented in the cause of providing what is believed to the most useful and readily understood description of procedures as well as of the principles and conceptual aspects of the invention.

EXAMPLE 1

A polyester gel coat No. 33 (produced by Makhteshim Chemical Works Ltd. Israel) which is composed of unsaturated polyester, Aerosil® thixotroping agent and $TiO_2$ to which was added 1% powdered aluminum was spread in parallel strips 12 cm wide at intervals of 8 cm in an amount of 160 g/m$^2$ over a mylar sheet. A mat of chopped fiberglass (400 g/m$^2$) was placed over the entire surface and unsaturated polyester resin (crystic® 193) mixed with MEK-peroxide and cobalt accelerator was poured in an amount of 1000 g/m$^2$ over the fibreglass mat. A second mylar sheet was placed over said resin and the composite sheet was placed between a pair of complementary corrugated molds in such a manner that the pigmented gel coat strips were aligned and inclined along parallel slopes of a corrugated mold while the remaining translucent composite polyester portions were inclined and aligned along the opposite parallel slopes of said mold. Pressure was applied and the polyester was allowed to cure. Upon releasing the cured composite corrugated sheet from the mold and the withdrawal of the mylar sheets from both sides thereof, there was obtained a light transmitting roofing or cladding corrugated structural panel having parallel slopes which are provided with said reflecting and opacifying material and which reflecting and opacifying material preferably extends up said parallel slopes even beyond the crests of said corrugated panel to form alternate light transmitting and light reflecting zones.

Said sheet was measured as having a uniform thickness of 1 mm, a modulus of elasticity of 750 Kg/m$^2$, a tensile strength of $2.0\times10^3$ Kg/cm$^2$ and a heat conductance of $4.5\times10^{-4}$ Cal. cm$^2$°C. Sec.

In tests carried out comparing light penetration through the translucent slopes and the reflecting slopes of said panel as compared with a standard green pigmented corrugated fibreglass reinforced polyester panel, the following results were noted.

| | Translucent Slopes | Reflecting Slopes | Standard Panel |
|---|---|---|---|
| Incident Light | 100% | 100% | 100% |
| Reflected Light | 4% | 88% | 30% |
| Absorbed Light | 10% | 10% | 35% |
| Transmitted Light | 86% | 2% | 35% |

In a further experiment to determine the degree of penetration of heat radiation through said panel, a heating lamp generating a measurable 140° C. was set up before several cups of water and a translucent panel section and a reflecting panel section were respectively placed between said heat source and said cups. After 30 minutes, the temperature of the water behind the translucent panel section was 85° C. while the temperature of the water in the cup behind the reflecting panel section was only 40° C.

From the above experiments, it will be readily apparent that the panels according to the present invention, in fact, are ideally suited to carry out their intended function and that the constructional and manufacturing features of the panels render them a major advance in the field of roofing and cladding structures.

EXAMPLE 2

In a manner similar to that described in Example 1 composite corrugated polyester sheets were obtained by applying the procedure of Example 1 in a continuous operation utilizing vacuum suction to shape the uncured polyester composite sheet over a corrugated mold.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard no attempt is made to show structural details of the panels in more detail than is necessary for a fundamental understanding of the invention the description taken with the drawings making apparent to those skilled in the art how the several forms of the invention may be embodied in practice.

Figure 1:
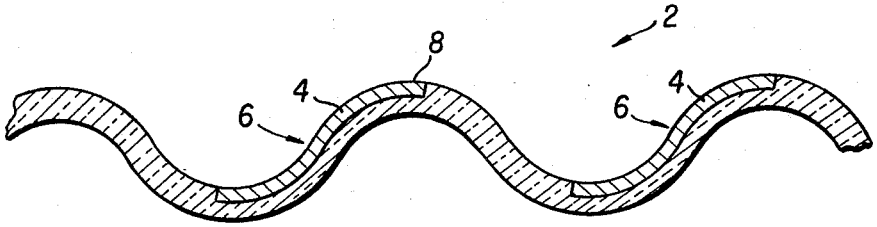
FIG. 1 is a cross-sectional view of a panel prepared according to Example 1.

Referring first to FIG. 1, there is shown a panel 2 according to the present invention whose cross-section resembles a sinusoidal curve and which is adapted to be used in conjunction with other conventional curved roofing materials, particularly other corrugated panels such as metal, asbestos, reinforced polyester or PVC panels of similar configuration thus permitting interchanging and overlapping of conventional corrugated and the present panels, making construction less expensive and more uniform and aesthetic in appearance.

As will be seen in this embodiment, the reflecting and opacifying material 4 is embedded within the surface of the panel 2 and concentrated in a thin layer near the upper surface thereof, extending up parallel slopes 6 of the panel beyond the crests 8 thereof.

Figure 2:
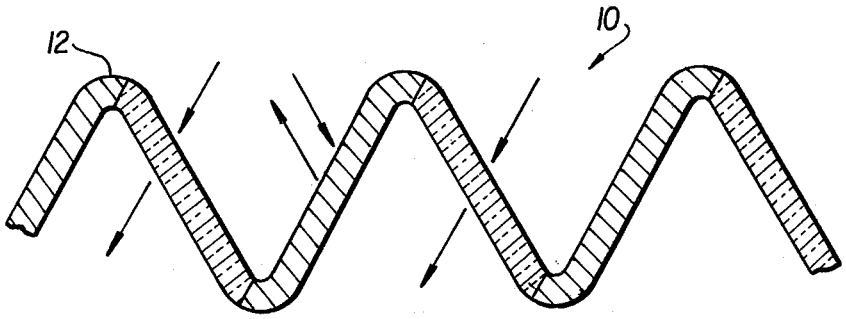
FIGS. 2 and 3 are cross-sectional views of panels of different possible configurations according to the present invention.
Figure 3:
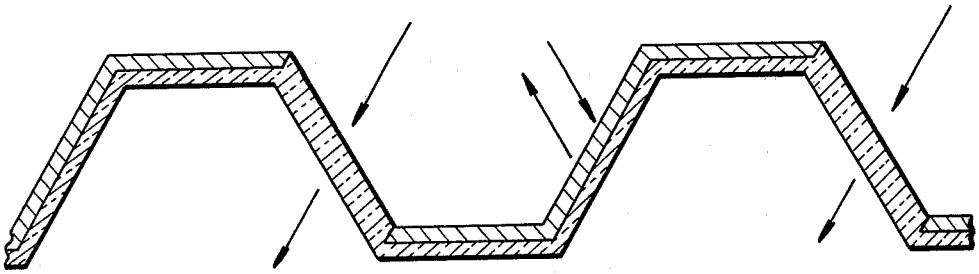

With reference to FIGS. 2 and 3 said figures illustrated how panels can be profiled to any desired slope so as to permit the optimum northern light to penetrate. The profiles can be so designed to obtain maximum light entry using specific slope angles whether flat or curved or combination of both. As stated, the panel may take on the shape of standard corrugated asbestos, or sheet metal or other standard corrugated profile and FIGS. 1, 2 and 3 exemplify various slopes and designs for the panels. Thus, in FIG. 2 the panel 10 crests at a sharper angle then the curved crests 8 of panel 2 of FIG. 1 and said panel is also provided with said opacifying and reflecting material 12 embedded within the surface thereof, however, dispersed instead of concentrated in a thin layer as in FIGS. 1 and 3.

FIG. 3 shows how a design can be arrived at whereby the translucent portion of the panel comprises a small fraction of the corrugated sheet. These panels can, therefore, be prepared by design to have different levels of opacity and transparency. For example, it is possible to prepare a panel having 60% opacity and 40% transparency or 80% opacity and only 20% transparency. Other designs and configurations and other uses for these panels will be apparent from the description.

Thus, while particular embodiments of this invention have been described, it will be evident to those skilled in the art that the present invention may be embodied in other specific forms without departing from the essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed is:

1. A light transmitting roofing or cladding panel consisting of a translucent, structural, rigid plastic sheet formed into a corrugated panel having two sets of slopes wherein the slopes of each set are respectively substantially identically oriented, the slopes of only one of said sets being provided with a reflecting and opacifying material embedded within the surface of said panel and the slopes of said other set being made translucent to form alternate light transmitting and light reflecting zones of a fixed ratio and wherein the area of the reflecting zones is equal to or greater than that of the light transmitting zones, whereby said panels are adapted upon proper positioning relative to the sun's apparent passage to allow natural daylight to pass therethrough while at the same time, minimizing penetration of the sun's heat radiation.

2. A light transmitting roofing or cladding panel according to claim 1 wherein said reflecting and opacifying material extends up said parallel slopes beyond the crests of said corrugated panel.

3. A light transmitting roofing or cladding panel according to claim 1 wherein said reflecting and opacifying material is concentrated in a thin layer near the upper surface of said panel.

4. A light transmitting roofing or cladding panel according to claim 1 wherein the edge of said panel is of uniform cross-section having a cross-sectional thickness of about 0.3 to about 3 mm.

5. A light transmitting roofing or cladding panel according to claim 4 wherein said panels have a cross-sectional thickness of about 0.5 to about 1.5 mm.

6. A light transmitting roofing or cladding panel according to claim 1 wherein said corrugated panel is shaped for overlapping juxtapositioning with standard asbestos and sheet metal corrugated panels.

7. A light transmitting roofing or cladding panel according to claim 6 wherein said corrugated panel is formed with curved crests for overlapping juxtapositioning with standard curved asbestos corrugated panels.

8. A light transmitting roofing or cladding panel according to claim 1 wherein said panel is formed from fiberglass reinforced polyester.

9. A method of providing natural sunlight for buildings, workshops and warehouses while minimizing penetration of the sun's heat rays consisting of providing a light transmitting roofing or cladding panel made of a translucent structural rigid plastic sheet formed into a corrugated structural panel wherein parallel slopes of the panel are provided with a reflecting and opacifying material to form alternate light transmitting and light reflecting zones of a fixed ratio and positioning said panel in a structure with the translucent light transmitting zones thereof substantially facing north.

* * * * *